US009463651B2

(12) United States Patent
Fukui et al.

(10) Patent No.: US 9,463,651 B2
(45) Date of Patent: Oct. 11, 2016

(54) INKJET PRINTER, METHOD OF CONTROLLING INKJET PRINTER AND COMPUTER PROGRAM

(71) Applicant: SCREEN Holdings Co., Ltd., Kyoto (JP)

(72) Inventors: Tamio Fukui, Kyoto (JP); Hideyuki Eto, Kyoto (JP)

(73) Assignee: Screen Holdings Co., Ltd., Kyoto (JP)

( * ) Notice: Subject to any disclaimer, the term of this patent is extended or adjusted under 35 U.S.C. 154(b) by 11 days.

(21) Appl. No.: 14/731,238

(22) Filed: Jun. 4, 2015

(65) Prior Publication Data

US 2015/0352867 A1 Dec. 10, 2015

(30) Foreign Application Priority Data

Jun. 6, 2014 (JP) ..... 2014-118214

(51) Int. Cl.

| | |
|---|---|
| ***B41J 29/38*** | (2006.01) |
| ***B41J 13/00*** | (2006.01) |
| ***B41J 11/42*** | (2006.01) |
| ***B41J 2/045*** | (2006.01) |

(52) U.S. Cl.

CPC ..... *B41J 13/0009* (2013.01); *B41J 2/0458* (2013.01); *B41J 2/04515* (2013.01); *B41J 2/04581* (2013.01); *B41J 2/04586* (2013.01); *B41J 2/04588* (2013.01); *B41J 2/04593* (2013.01); *B41J 11/42* (2013.01)

(58) Field of Classification Search

None

See application file for complete search history.

(56) References Cited

U.S. PATENT DOCUMENTS

2002/0135631 A1* 9/2002 Sasaki ..... B41J 13/0009 347/19
2008/0106567 A1* 5/2008 Nishimura ..... B41J 2/16526 347/17

FOREIGN PATENT DOCUMENTS

| | | | |
|---|---|---|---|
| JP | 11-179893 A | | 7/1999 |
| JP | 11179893 A | * | 7/1999 |
| JP | 2005-199445 A | | 7/2005 |
| JP | 2005199445 A | * | 7/2005 |

* cited by examiner

*Primary Examiner* — Shelby Fidler
*Assistant Examiner* — Tracey McMillion
(74) *Attorney, Agent, or Firm* — McDermott Will & Emery LLP

(57) ABSTRACT

A inkjet printer calculates a print percentage indicative of a load on a pressurizing mechanism for each block, based on print data, and then factors in the print percentage for each block to determine the upper limit of a transport speed so that the upper limit becomes slower as the print percentage increases and becomes slower as a printing distance in a transport direction corresponding to the print data increases. This provides the upper limit of the transport speed in consideration for not only a spontaneous temperature increase in each block but also a temperature increase due to the influence of its surrounding blocks. This allows the blocks in a head to operate at temperatures within a permissible range.

15 Claims, 14 Drawing Sheets

Fig.7

T n=1

| S(1) (%) | PRINTING DISTANCE (meter) | | | | | | | | |
|---|---|---|---|---|---|---|---|---|---|
| | -10 | -100 | -250 | -500 | -750 | -1000 | -1250 | -1500 | 1500- |
| -70 | 60 | 60 | 60 | 60 | 60 | 60 | 60 | 60 | 60 |
| -80 | 60 | 60 | 60 | 60 | 55 | 55 | 50 | 50 | 50 |
| -90 | 60 | 60 | 55 | 55 | 50 | 50 | 45 | 45 | 45 |
| -100 | 60 | 55 | 50 | 50 | 45 | 45 | 40 | 40 | 35 |

(mpm)

Fig.8

T n=2

| S(2) (%) | PRINTING DISTANCE (meter) | | | | | | | | |
|---|---|---|---|---|---|---|---|---|---|
| | -10 | -100 | -250 | -500 | -750 | -1000 | -1250 | -1500 | 1500- |
| -130 | 60 | 60 | 60 | 60 | 60 | 60 | 60 | 60 | 60 |
| -150 | 60 | 60 | 55 | 55 | 50 | 50 | 50 | 45 | 45 |
| -170 | 60 | 55 | 50 | 50 | 45 | 45 | 45 | 40 | 40 |
| -200 | 60 | 50 | 45 | 45 | 40 | 40 | 35 | 35 | 35 |

(mpm)

Fig.9

T n=3

| S(3) (%) | PRINTING DISTANCE (meter) | | | | | | | | |
|---|---|---|---|---|---|---|---|---|---|
| | -10 | -100 | -250 | -500 | -750 | -1000 | -1250 | -1500 | 1500- |
| -190 | 60 | 60 | 60 | 60 | 60 | 60 | 60 | 60 | 60 |
| -220 | 60 | 55 | 50 | 50 | 50 | 45 | 45 | 45 | 40 |
| -250 | 60 | 50 | 45 | 45 | 45 | 40 | 40 | 40 | 35 |
| -300 | 60 | 45 | 40 | 35 | 35 | 35 | 35 | × | × |

(mpm)

Fig.10

T n=4

| S(4) (%) | PRINTING DISTANCE (meter) | | | | | | | | |
|---|---|---|---|---|---|---|---|---|---|
| | -10 | -100 | -250 | -500 | -750 | -1000 | -1250 | -1500 | 1500- |
| -260 | 60 | 60 | 60 | 60 | 60 | 60 | 60 | 60 | 60 |
| -300 | 60 | 50 | 50 | 45 | 45 | 45 | 40 | 40 | 40 |
| -340 | 60 | 45 | 45 | 40 | 40 | 35 | 35 | 35 | × |
| -400 | 60 | 35 | 35 | 35 | 35 | 35 | 35 | × | × |

(mpm)

Fig.11

T n=5

| S(5) (%) | PRINTING DISTANCE (meter) | | | | | | | | |
|---|---|---|---|---|---|---|---|---|---|
| | -10 | -100 | -250 | -500 | -750 | -1000 | -1250 | -1500 | 1500- |
| -330 | 60 | 60 | 60 | 60 | 60 | 60 | 60 | 60 | 60 |
| -380 | 60 | 50 | 45 | 45 | 45 | 40 | 40 | 40 | 40 |
| -430 | 60 | 45 | 45 | 40 | 40 | 35 | 35 | 35 | × |
| -500 | 60 | 35 | 35 | 35 | 35 | 35 | × | × | × |

(mpm)

Fig.14

T

| Pmax | PRINTING DISTANCE (meter) | | | | | | | | |
|---|---|---|---|---|---|---|---|---|---|
| | -10 | -100 | -250 | -500 | -750 | -1000 | -1250 | -1500 | 1500- |
| -70 | 60 | 60 | 60 | 60 | 60 | 60 | 60 | 60 | 60 |
| -80 | 60 | 60 | 55 | 55 | 50 | 50 | 50 | 45 | 45 |
| -90 | 60 | 50 | 45 | 45 | 45 | 40 | 40 | 40 | 35 |
| -100 | 60 | 35 | 35 | 35 | 35 | 35 | 35 | × | × |
| 100- | 60 | 35 | 35 | 35 | 35 | 35 | × | × | × |

(mpm)

INKJET PRINTER, METHOD OF CONTROLLING INKJET PRINTER AND COMPUTER PROGRAM

CROSS REFERENCE TO RELATED APPLICATIONS

This application claims priority to Japanese Patent Application No. 2014-118214 filed Jun. 6, 2015 the subject matter of which is incorporated herein by reference in entirety.

BACKGROUND OF THE INVENTION

1. Field of the Invention

The present invention relates to a technique for determining a proper print speed in an inkjet printer.

2. Description of the Background Art

An inkjet printer includes pressure generating elements such as piezoelectric elements and electrothermal converters for the purpose of ejecting ink from a plurality of nozzles provided in a head. For this reason, the temperature of the head is increased by the drive load of the pressure generating elements at the time of printing. There is apprehension that the increase in the temperature of the head gives rise to problems including the decrease in image quality resulting from changes in physical properties of ink, damages to driving circuits of the pressure generating elements, and the like.

A known solution to such problems is the technique of suspending printing when the temperature of the head reaches a predetermined value or higher. This technique is disclosed, for example, in Japanese Patent Application Laid-Open No. 11-179893 (1999), paragraphs 0003 to 0006. The suspension of printing, however, causes problems such as the decrease in productivity and the difficulty in providing uniform image quality.

The greater the drive load of the pressure generating elements is, the more significantly the increase in the temperature of the head occurs. That is, the greater the amount of ink ejected toward printing paper is, the more prone to increase the temperature of the head is. Also, the continuous execution of printing causes the temperature of the head to increase gradually. Thus, even after several pages are successfully printed at a certain print speed without any problem, there are cases in which further continuous printing causes the temperature of the head to exceed a permissible value. It is, however, not preferable from the viewpoint of productivity to print at all times at an extremely low speed such that the continuous printing of 100% solidly shaded images for a long time cause no problem.

It is also contemplated to detect the temperature inside the head at the time of printing to change the print speed during printing, based on the detected temperature. However, changing the print speed during printing results in complicated control for maintaining constant printing precision and constant image quality.

To solve these problems, Japanese Patent Application Laid-Open No. 11-179893 (1999) discloses the technique of calculating a print density from information in a print buffer to determine the print speed in accordance with the calculated print density for the purpose of printing at a constant speed without the suspension of printing.

Unfortunately, an inkjet printer including a plurality of heads supplies print data to the heads in a distributed manner. This makes it impossible to expect the elevated temperature condition of each head by only referencing the print density of the entire print data. Also, when a plurality of blocks each serving as a control unit are provided in one head, there are differences in elevated temperature condition between the blocks. In such a case, it is also impossible to expect the elevated temperature condition of each block by only referencing the print density of the entire print data.

Japanese Patent Application Laid-Open No. 2005-199445 discloses the technique of determining the maximum value of the print speed by using the maximum value of the amount of ink ejection per unit area in an inkjet printer including an elongated head because a partial temperature increase is expected to occur in a region where a large amount of ink is ejected per unit area although the total number of times of ink ejection is not necessarily high (see paragraphs 0082 to 0084).

In a head having a plurality of blocks arranged widthwise, each of the blocks is not only increased in temperature spontaneously by the ejection of ink but also influenced by the increase in temperature of its surrounding blocks. Only referencing the maximum value of the amount of ink ejection per unit area as in Japanese Patent Application Laid-Open No. 2005-199445 cannot achieve the determination of a proper print speed in consideration for the thermal influence of the surrounding blocks.

SUMMARY OF THE INVENTION

It is therefore an object of the present invention to provide a technique capable of determining a proper transport speed in an inkjet printer in consideration for not only a spontaneous temperature increase in each block but also a temperature increase due to the influence of its surrounding blocks.

A first aspect of the present invention is intended for an inkjet printer comprising: a head for recording an image on a recording medium, based on print data; a transport mechanism for moving the recording medium in a transport direction relative to the head; a controller for controlling the head and the transport mechanism; and a computation part for determining the upper limit of a transport speed of said recording medium moved by the transport mechanism, based on the print data, the head including a plurality of blocks arranged in a width direction perpendicular to the transport direction, a plurality of nozzles arranged in the blocks, and a pressurizing mechanism for causing the nozzles to eject droplets, the computation part performing the steps of a) calculating a load factor indicative of a load on the pressurizing mechanism for each of the blocks, based on the print data, and b) factoring in the load factor for each of the blocks to determine the upper limit of the transport speed so that the upper limit becomes slower as the load factor increases and becomes slower as a printing distance in the transport direction corresponding to the print data increases, the controller controlling the transport mechanism at a transport speed not greater than the upper limit.

A second aspect of the present invention is intended for a method of controlling an inkjet printer which records an image on a recording medium by ejecting ink droplets from a plurality of nozzles in a head by means of a pressurizing mechanism, based on print data, while moving the recording medium in a transport direction relative to the head. The method comprises the steps of: a) calculating a load factor indicative of a load on the pressurizing mechanism for each block, based on the print data, the blocks being arranged in a direction perpendicular to the transport direction in the head; b) factoring in the load factor for each of the blocks to determine the upper limit of the transport speed so that the upper limit becomes slower as the load factor increases and becomes slower as a printing distance in the transport direction corresponding to the print data increases; and c) moving the recording medium relative to the head at a transport speed not greater than the upper limit.

A third aspect of the present invention is intended for a storage medium readable by a computer, the storage medium having stored therein a computer program for determining the upper limit of a transport speed in an inkjet printer which records an image on a recording medium by ejecting ink droplets from a plurality of nozzles in a head by means of a pressurizing mechanism, based on print data, while moving the recording medium in a transport direction relative to the head. The computer program causes a computer to perform the steps of: a) calculating a load factor indicative of a load on the pressurizing mechanism for each block, based on the print data, the blocks being arranged in a direction perpendicular to the transport direction in the head; and b) factoring in the load factor for each of the blocks to determine the upper limit of the transport speed so that the upper limit becomes slower as the load factor increases and becomes slower as a printing distance in the transport direction corresponding to the print data increases.

According to the first to third aspects of the present invention, the upper limit of the transport speed is determined while the load factor for each block is factored in. This provides the upper limit of the transport speed in consideration for not only a spontaneous temperature increase in each block but also a temperature increase due to the influence of its surrounding blocks. This allows the blocks in the head to operate at temperatures within a permissible range.

These and other objects, features, aspects and advantages of the present invention will become more apparent from the following detailed description of the present invention when taken in conjunction with the accompanying drawings.

BRIEF DESCRIPTION OF THE DRAWINGS

FIGS. 7 to 11 show examples of table data T for use in the first preferred embodiment;

FIG. 14 shows an example of the table data T for use in the second preferred embodiment;

DESCRIPTION OF THE PREFERRED EMBODIMENTS

Preferred embodiments according to the present invention will now be described with reference to the drawings.

<1. First Preferred Embodiment>

<1-1. Configuration of Inkjet Printer>

Figure 1:
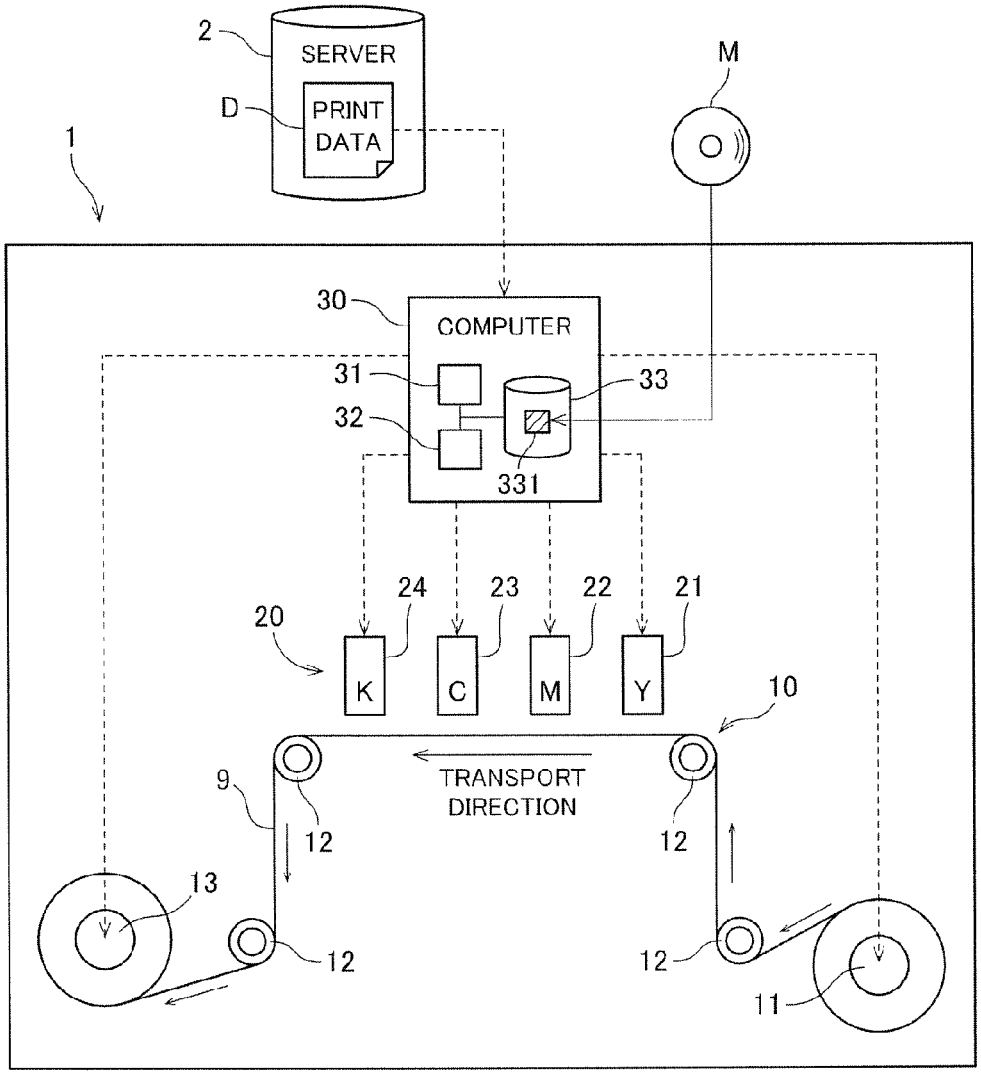
FIG. 1 is a diagram showing the configuration of an inkjet printer.
Figure 2:
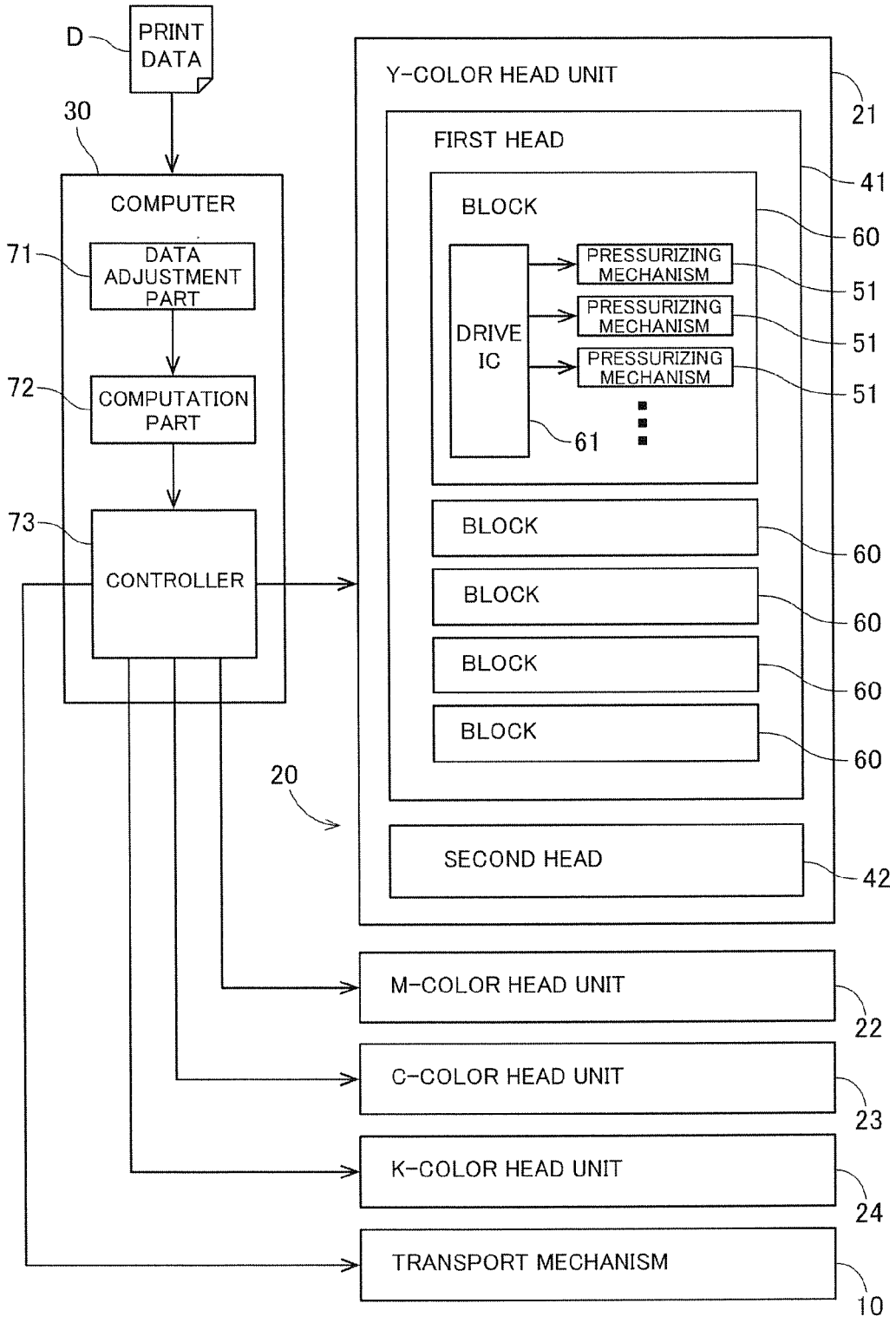
FIG. 2 is a block diagram showing the configuration of a control system in the inkjet printer.

FIG. 1 is a diagram showing the configuration of an inkjet printer 1 according to a first preferred embodiment of the present invention. FIG. 2 is a block diagram showing the configuration of a control system in the inkjet printer 1. This inkjet printer 1 is an apparatus which records a color image on printing paper 9 that is a recording medium in the form of an elongated sheet by ejecting ink from a plurality of head units 21 to 24 toward the printing paper 9 while transporting the printing paper 9. As shown in FIGS. 1 and 2, the inkjet printer 1 includes a transport mechanism 10, an image recorder 20, and a computer 30.

The transport mechanism 10 is a mechanism for transporting the printing paper 9 in a transport direction extending along the length of the printing paper 9. The transport mechanism 10 according to the present preferred embodiment includes an unwinder 11, a plurality of rollers 12 and a winder 13. The printing paper 9 is unwound from the unwinder 11, and is transported along a transport path formed by the plurality of rollers 12. Each of the rollers 12 rotates about a horizontal axis to guide the printing paper 9 downstream of the transport path. The transported printing paper 9 is wound and collected on the winder 13.

As shown in FIG. 1, the printing paper 9 is moved under the image recorder 20 substantially horizontally in a direction in which the head units 21 to 24 are arranged. During the substantially horizontal movement, the recording surface of the printing paper 9 faces toward the head units 21 to 24 disposed thereover. The printing paper 9 comes in contact with the rollers 12, so that tension is applied to the printing paper 9. This suppresses slack and wrinkles in the printing paper 9 during the transport.

The image recorder 20 is a section for ejecting ink droplets onto the printing paper 9 transported by the transport mechanism 10. The head units 21 to 24 of the image recorder 20 according to the present preferred embodiment are specifically as follows: a Y-color head unit 21, an M-color head unit 22, a C-color head unit 23, and a K-color head unit 24. The four head units 21 to 24 eject ink droplets of respective colors, i.e. Y (Yellow), M (Magenta), C (Cyan) and K (Black), which are color components of a color image onto the recording surface of the printing paper 9.

Figure 3:
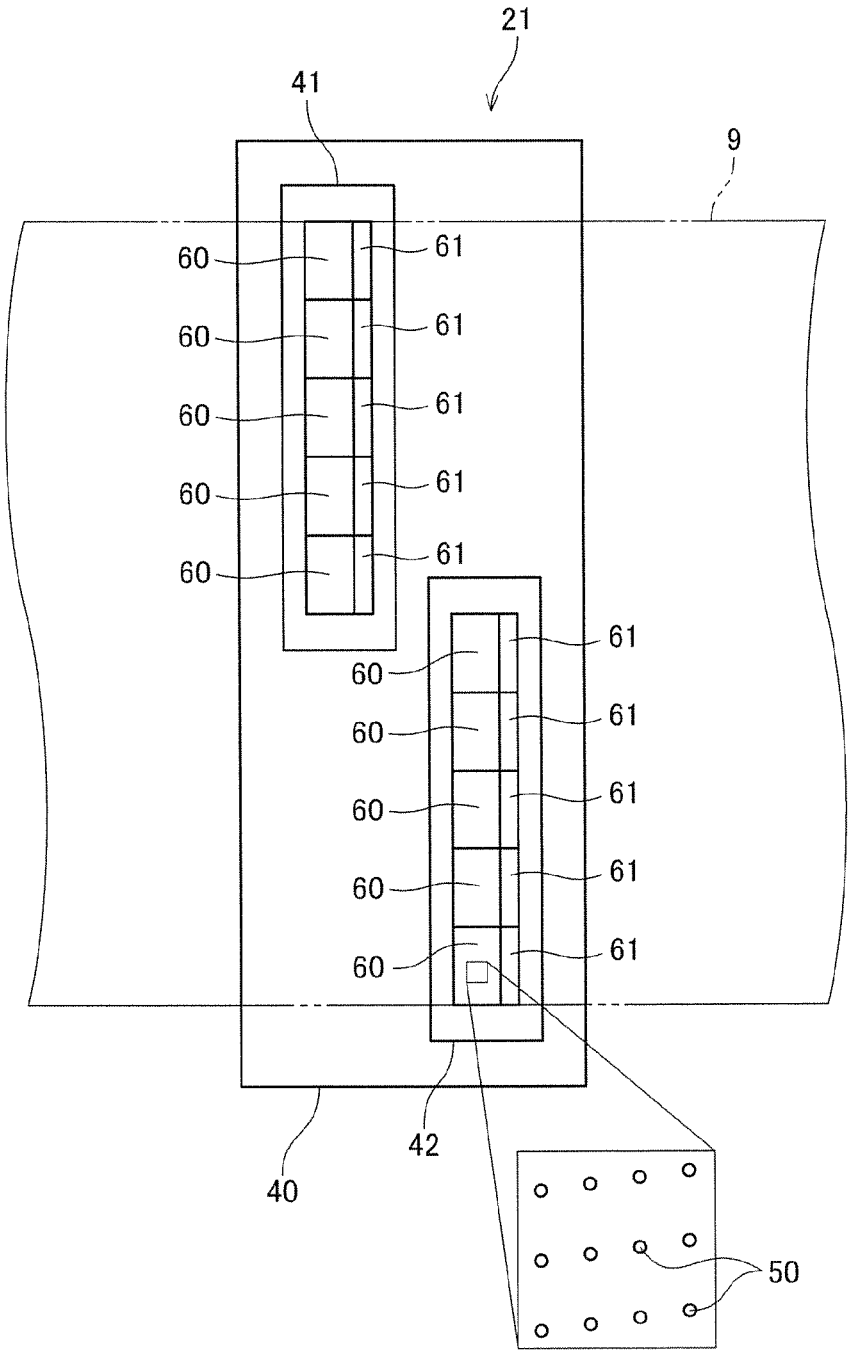
FIG. 3 is a bottom view of a Y-color head unit.

FIG. 3 is a bottom view of the Y-color head unit 21. As shown in FIG. 3, the Y-color head unit 21 according to the present preferred embodiment includes a first head 41, a second head 42, and a housing 40 for holding the heads 41 and 42. Each of the first head 41 and the second head 42 has an exposed ejection surface at the lower surface of the housing 40. As shown in FIG. 3, the first head 41 and the second head 42 are arranged at positions shifted from each other in the transport direction, and are arranged at positions shifted from each other in a width direction (a horizontal direction perpendicular to the transport direction) so as to cover the full area as seen in the width direction.

As shown on an enlarged scale in FIG. 3, nozzles 50 are disposed in a regular alignment in the lower surface of each of the first head 41 and the second head 42. The nozzles 50 are arranged at positions shifted from each other in the width direction, and each of the nozzles 50 is assigned to a region having a width of one pixel on the printing paper 9.

Pressurizing mechanisms 51 (with reference to FIG. 2) corresponding respectively to the nozzles 50 are provided inside the heads 41 and 42. When each of the pressurizing mechanisms 51 is brought into operation, pressure is applied to ink stored in an upper part of a corresponding one of the nozzles 50, so that ink droplets are ejected from the nozzle 50 corresponding to each pressurizing mechanism 51 toward the printing paper 9. Examples of the pressurizing mechanisms 51 used herein include piezoelectric type pressurizing mechanisms which apply pressure to ink by means of piezoelectric elements that deform in accordance with voltage, and thermal type pressurizing mechanisms which apply pressure to ink by means of bubbles generated by heating.

Five regions arranged in the width direction are provided in the lower surface of each of the first head 41 and the second head 42. The five regions are referred to hereinafter as blocks 60. All of the nozzles 50 in the heads 41 and 42 belong to any one of the five blocks 60. Each of the first head 41 and the second head 42 includes five drive ICs 61 responsible for the respective blocks 60. Each of the drive ICs 61 drives the pressurizing mechanisms 51 for the nozzles 50 disposed in a corresponding one of the blocks 60.

While the structure of the Y-color head unit 21 is described above, the three remaining head units (M-color head unit 22, C-color head unit 23 and K-color head unit 24) are similar in structure to the Y-color head unit 21. Thus, the structure of the three remaining head units 22 to 24 will not be repeatedly discussed.

A dryer unit for drying ink ejected onto the recording surface of the printing paper 9 may be further provided downstream of the head units 21 to 24 in the transport direction. The dryer unit, for example, blows a heated gas toward the printing paper 9 to vaporize a solvent contained in the ink adhering to the printing paper 9, thereby drying the ink. The dryer unit may be of the type which dries the ink by other methods such as irradiation with light.

The computer 30 is a means for performing various computation processes and for controlling the operations of the components in the inkjet printer 1. As shown in FIGS. 1 and 2, the computer 30 is electrically connected to the transport mechanism 10 and the four head units 21 to 24 described above. The computer 30 is connected to a server 2 provided outside the inkjet printer 1 for communication therewith. Submitted print data D is stored in the server 2.

As shown in FIG. 1, the computer 30 includes a processor 31 such as a CPU, a memory 32 such as a RAM, and a storage part 33 such as a hard disk drive. A computer program 331 for execution of the printing process is installed on the computer 30. The computer program 331 is read, for example, from a storage medium M readable by the computer 30, such as a CD and a DVD, and is stored in the storage part 33 provided in the computer 30.

The installation of the computer program 331 on the computer 30 allows the implementation of the functions of a data adjustment part 71, a computation part 72 and a controller 73 in the computer 30, as shown in FIG. 2.

The data adjustment part 71 adjusts the print data D read from the server 2 to generate print data D for driving the transport mechanism 10 and the head units 21 to 24. The computation part 72 determines the upper limit of a transport speed of the printing paper 9 transported by the transport mechanism 10, based on the adjusted print data D. The details of the process of determining the upper limit by the computation part 72 will be described later.

The controller 73 sends control signals to the transport mechanism 10 and the four head units 21 to 24 to control the operations of these components. The controller 73 causes the transport mechanism 10 to operate at a transport speed equal to or lower than the upper limit determined by the computation part 72. The controller 73 also sends a control signal providing an instruction to eject ink to each of the head units 21 to 24, based on the print data D adjusted by the data adjustment part 71. Upon receipt of the control signal, each of the head units 21 to 24 causes the drive ICs 61 provided for the respective blocks 60 to drive the plurality of pressurizing mechanisms 51. Thus, ink droplets of the respective colors are ejected from the nozzles 50 of the head units 21 to 24. As a result, an image corresponding to the print data D is recorded on the recording surface of the printing paper 9.

<1-2. Printing Process>

Figure 4:
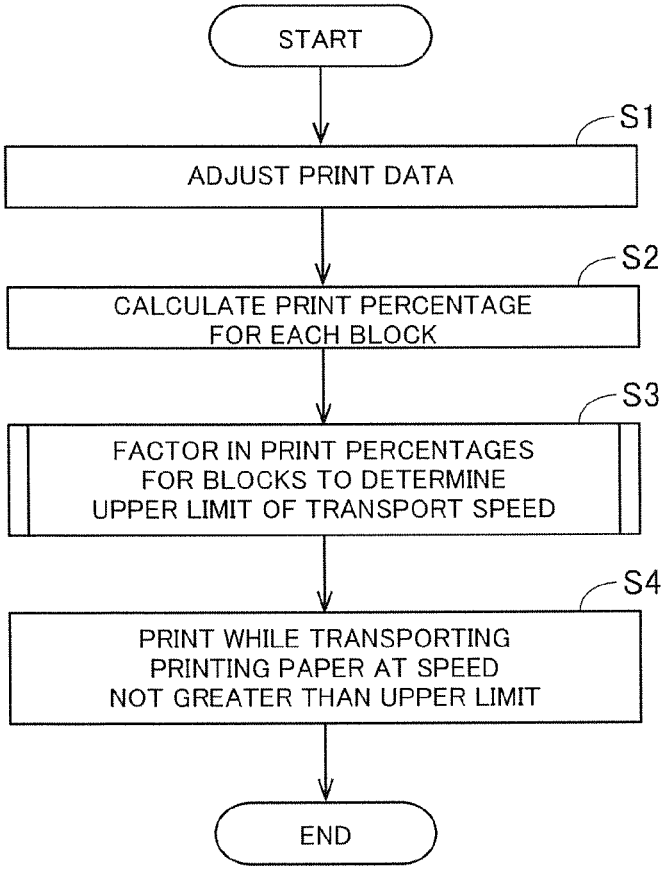
FIG. 4 is a flow diagram showing a procedure for a printing process.
Figure 5:
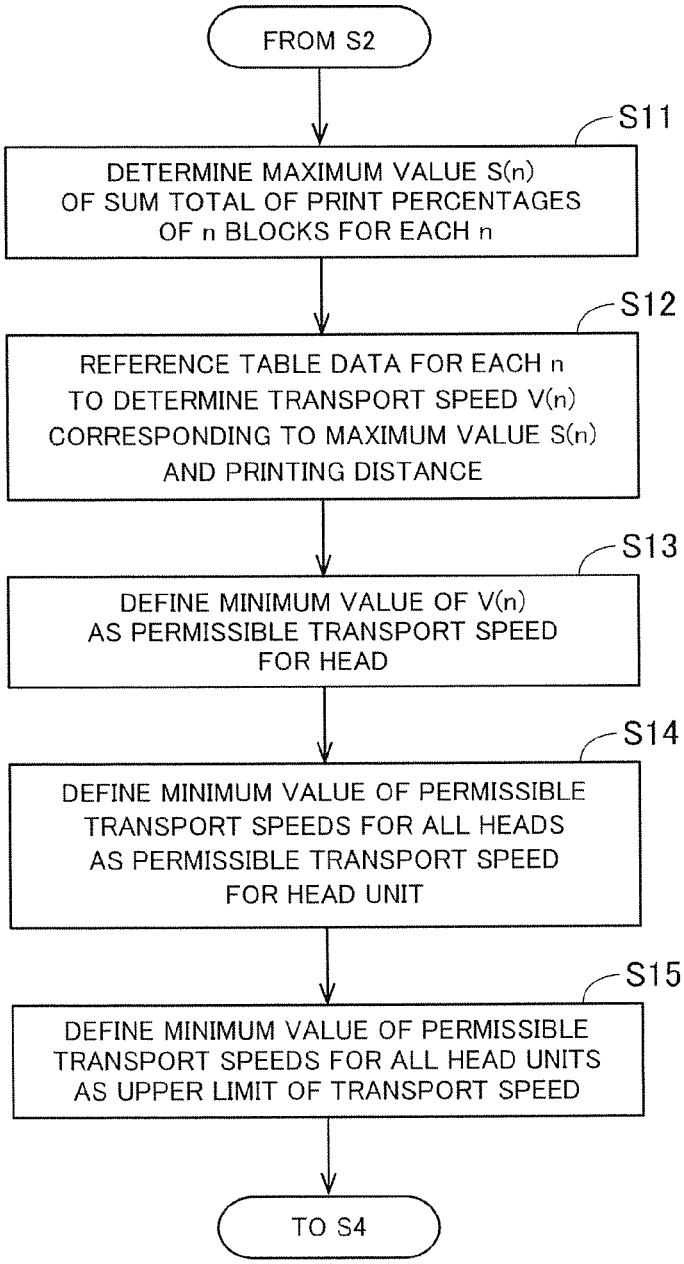
FIG. 5 is a detailed flow diagram of Step S3 according to a first preferred embodiment.
Figure 6:
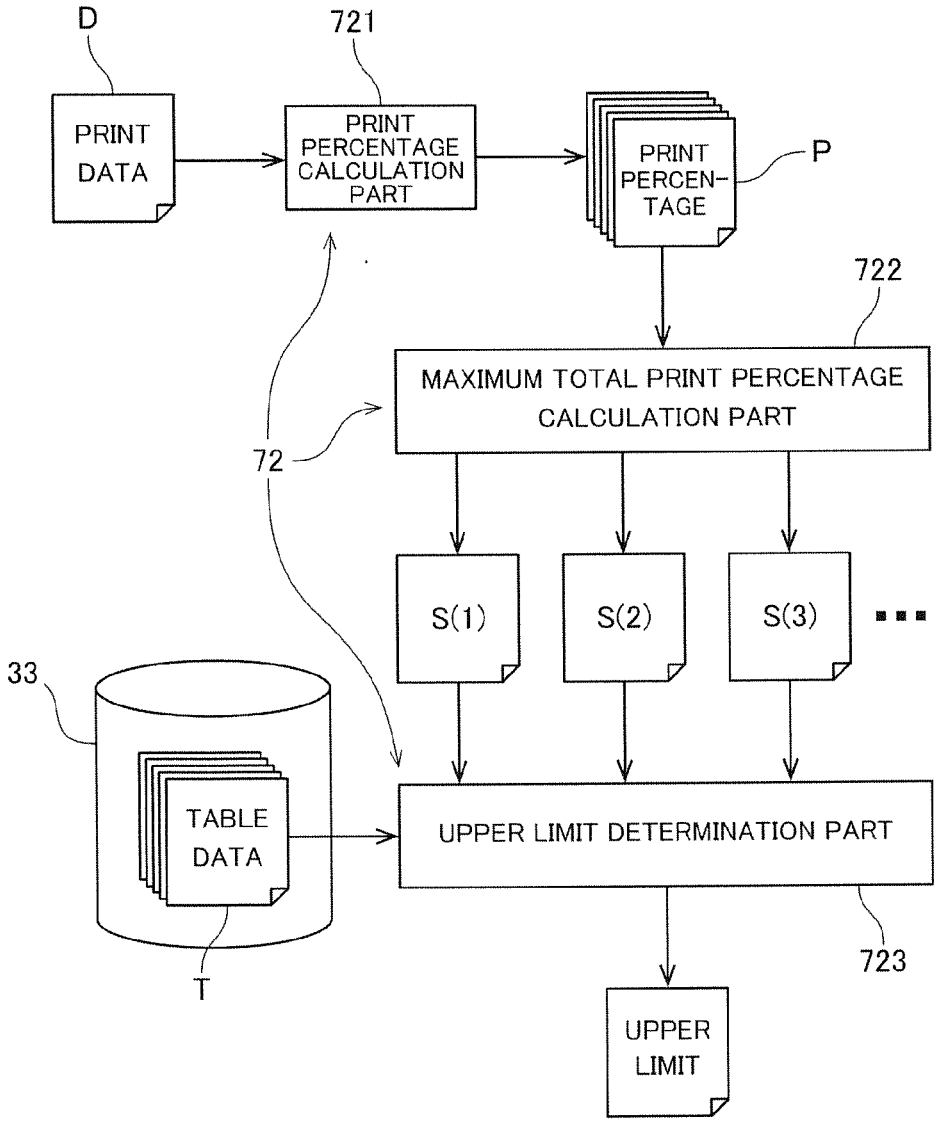
FIG. 6 is a block diagram showing the processes in Steps S2 and S3 according to the first preferred embodiment.

Next, the details of the printing process in the inkjet printer 1 will be described. FIG. 4 is a flow diagram showing a procedure for the printing process. FIG. 5 is a flow diagram showing the details of the process in Step S3 in FIG. 4. FIG. 6 is a block diagram conceptually showing the processes in Steps S2 and S3.

For the printing process in the inkjet printer 1, the computer 30 initially reads designated print data D from the server 2. Then, the data adjustment part 71 in the computer 30 adjusts the read print data D (in Step S1). The data adjustment part 71 adds information, for example, about a recording position of an image on the printing paper 9 and a spacing between images to the print data D. This produces print data D for driving the transport mechanism 10 and the head units 21 to 24.

Next, as shown in FIG. 6, a print percentage calculation part 721 calculates a print percentage P for each of the blocks 60, based on the adjusted print data D (in Step S2). The print percentage calculation part 721 is part of the computation part 72, and the function of the print percentage calculation part 721 is implemented by the computer program 331. In Step S2, the print percentage P for each color component in a printing area for which each of the blocks 60 is responsible is calculated for every block 60 included in the four head units 21 to 24. As a result, print percentages P corresponding to the respective blocks 60 are obtained.

The print percentages P in the present preferred embodiment will be described. In this inkjet printer 1, the size of ink droplets ejected from the nozzles 50 is selectable between three levels: large, medium and small. Which size of the ink droplets ejected from the nozzles 50 is selected between large, medium and small is determined by the density of pixels in an image. The greater the size of the ink droplets ejected from the nozzles 50 is, the greater the load on the pressurizing mechanisms 51 is. The computation part 72 determines which size of the ink droplets ejected from the nozzles 50 is selected, based on the print data D. Then, the proportion of the amount of ink ejected in each of the blocks 60 is calculated as the print percentage P, which is defined as 100% when the largest droplets are ejected from all of the nozzles 50.

In the present preferred embodiment, the aforementioned print percentage P is used as a "load factor" indicative of the load on the pressurizing mechanisms 51. However, the "load factor" according to the present invention need not necessarily be the print percentage P calculated in the aforementioned procedure. For example, the "load factor" may be calculated from the number of times of ink ejection for each block 60. Alternatively, the expected amount of operation and expected power consumption of the pressurizing mechanisms 51 may be determined for each block 60 and defined as the "load factor".

Subsequently, the computation part 72 references the print percentages P for the blocks 60 to determine the upper limit of the transport speed of the printing paper 9 transported by the transport mechanism 10 (in Step S3). The higher the aforementioned print percentage P is, the greater the load on the pressurizing mechanisms 51 in each block 60 is. The longer a printing distance (a dimension of an image recorded on the printing paper 9 as measured in the transport direction) is, the greater the load on the pressurizing mechanisms 51 in each block 60 is. The increase in the load on the pressurizing mechanisms 51 is prone to increase the temperature of a corresponding block 60. In Step S3, with the print percentages P for the blocks 60 factored in, the upper limit of the transport speed is hence determined so as to become slower as the print percentages P collectively increase and to become slower as the printing distance corresponding to the print data D increases.

With reference to FIGS. 5 and 6, the details of the process of determining the upper limit in Step S3 will be described. A maximum total print percentage calculation part 722 and an upper limit determination part 723 in FIG. 6 are parts of the computation part 72. The functions of the maximum total print percentage calculation part 722 and the upper limit determination part 723 are implemented by the computer program 331.

In Step S3, the maximum total print percentage calculation part 722 initially calculating the maximum value S(n) of the sum total of the print percentages P of n blocks 60 (where n is an integer equal to or greater than 1) selected from among the five blocks 60 in each of the heads 41 and 42 while changing the value of n in the range of 1 to 5 ($1 \leq n \leq 5$) (in Step S11). This provides five maximum values S(n).

For example, when the print percentages P of the five blocks 60 are 80%, 60%, 70%, 10% and 30%, the maximum value of the print percentage P of one block 60 selected from among the five blocks 60 is S(1)=80%. The maximum value of the sum total of the print percentages P of two blocks 60 selected from among the five blocks 60 is as follows: S(2)=80%+70%=150%. The maximum value of the sum total of the print percentages P of three blocks 60 selected from among the five blocks 60 is as follows: S(3)=80%+60%+70%=210%. The maximum value of the sum total of the print percentages P of four blocks 60 selected from among the five blocks 60 is as follows: S(4)=80%+60%+70%+30%=240%. The maximum value of the sum total of the print percentages P of five blocks 60 selected from among the five blocks 60 is as follows: S(5)=80%+60%+70%+10%+30%=250%.

Next, the upper limit determination part 723 references table data T prepared for each number n to determine a transport speed V(n) (in Step S12). FIGS. 7 to 11 show examples of the table data T for n=1, n=2, n=3, n=4 and n=5, respectively. These table data T are previously stored in the storage part 33 of the computer 30. The values of the transport speed V(n) corresponding to the maximum value S(n) and the printing distance are specified in detail in each table data T. The numerical values in the table data T are previously determined by experiment and the like. Crosses (x) in the table data T mean that printing is impossible even when the transport speed is decreased. By referencing the table data T, the upper limit determination part 723 is capable of determining the transport speed V(n) corresponding to the maximum value S(n) provided in Step S11 and the printing distance represented by the print data D.

For example, when S(1)=80% and the printing distance is 600 m, the corresponding transport speed is V(1)=55 mpm, as will be found from the table data T of FIG. 7. When S(2)=150% and the printing distance is 600 m, the corresponding transport speed is V(2)=50 mpm, as will be found from the table data T of FIG. 8. When S(3)=210% and the printing distance is 600 m, the corresponding transport speed is V(3)=50 mpm, as will be found from the table data T of FIG. 9. When S(4)=240% and the printing distance is 600 m, the corresponding transport speed is V(4)=60 mpm, as will be found from the table data T of FIG. 10. When S(5)=250% and the printing distance is 600 m, the corresponding transport speed is V(5)=60 mpm, as will be found from the table data T of FIG. 10.

Subsequently, the upper limit determination part 723 defines the minimum value of the five obtained transport speeds V(1) to V(5) as a permissible transport speed for a corresponding head (in Step S13). In the aforementioned example, 50 mpm which is the minimum value of the five transport speeds V(1) to V(5) is defined as the permissible transport speed for the corresponding head. The upper limit determination part 723 determines the permissible transport speeds for the two heads 41 and 42 of a head unit by using the aforementioned procedure, and defines the minimum value of the two permissible transport speeds as the permissible transport speed for the head unit (in Step S14).

Thereafter, the upper limit determination part 723 defines the minimum value of the permissible transport speeds determined for the four head units 21 to 24 as the upper limit of the transport speed of the printing paper 9 transported by the transport mechanism 10 (in Step S15).

After the determination of the upper limit of the transport speed, the controller 73 in the computer 30 controls the transport mechanism 10. Thus, the transport mechanism 10 transports the printing paper 9 at a constant transport speed equal to or lower than the upper limit. The controller 73 also controls the head units 21 to 24, based on the print data D adjusted by the data adjustment part 71. Thus, ink droplets of the four colors are ejected from the nozzles 50 of the head units 21 to 24. As a result, an image corresponding to the print data D is printed on the recording surface of the printing paper 9 (in Step S4).

In this manner, the inkjet printer 1 according to the present preferred embodiment determines the upper limit of the transport speed while factoring in the print percentages P for the blocks 60. This provides the upper limit of the transport speed in consideration for not only a spontaneous temperature increase in each block 60 but also a temperature increase due to the influence of its surrounding blocks 60. This allows the blocks 60 in each of the head units 21 to 24 to operate at temperatures within a permissible range.

Also, the upper limit of the transport speed is determined in the present preferred embodiment, based on the print data D adjusted by the data adjustment part 71, rather than the print data D as submitted. In this manner, the use of the print data D for driving the head units 21 to 24 allows the print percentage P for each block 60 to be calculated more accurately. The upper limit of the transport speed is therefore determined more properly.

The actually measured values of the transport speed obtained by test printing and the like are more easily reflected directly in the table data T in the method of the first preferred embodiment than in the method of a second preferred embodiment to be described below. That is, it is unnecessary to determine a plurality of coefficients from the result of the test printing and to set up equations conforming to the result of the test printing. Therefore, the method of the first preferred embodiment is carried out more easily than that of the second preferred embodiment.

<2. Second Preferred Embodiment>

Next, the second preferred embodiment of the present invention will be described. The inkjet printer 1 of the second preferred embodiment is similar to that of the first preferred embodiment in apparatus configuration shown in FIGS. 1 to 3. The second preferred embodiment, however, differs from the first preferred embodiment in procedure for the process of determining the upper limit in Step S3.

Figure 12:
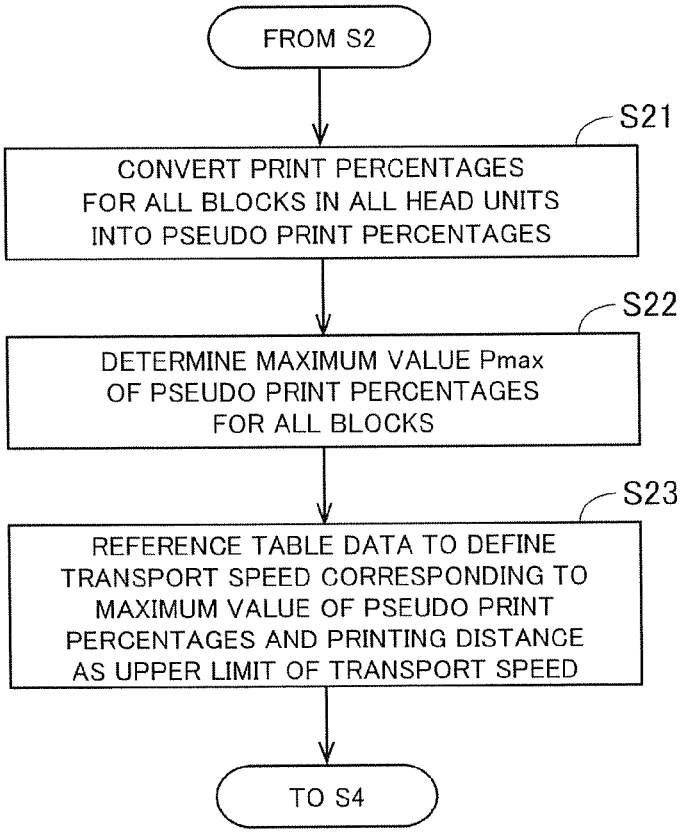
FIG. 12 is a detailed flow diagram of Step S3 according to a second preferred embodiment.
Figure 13:
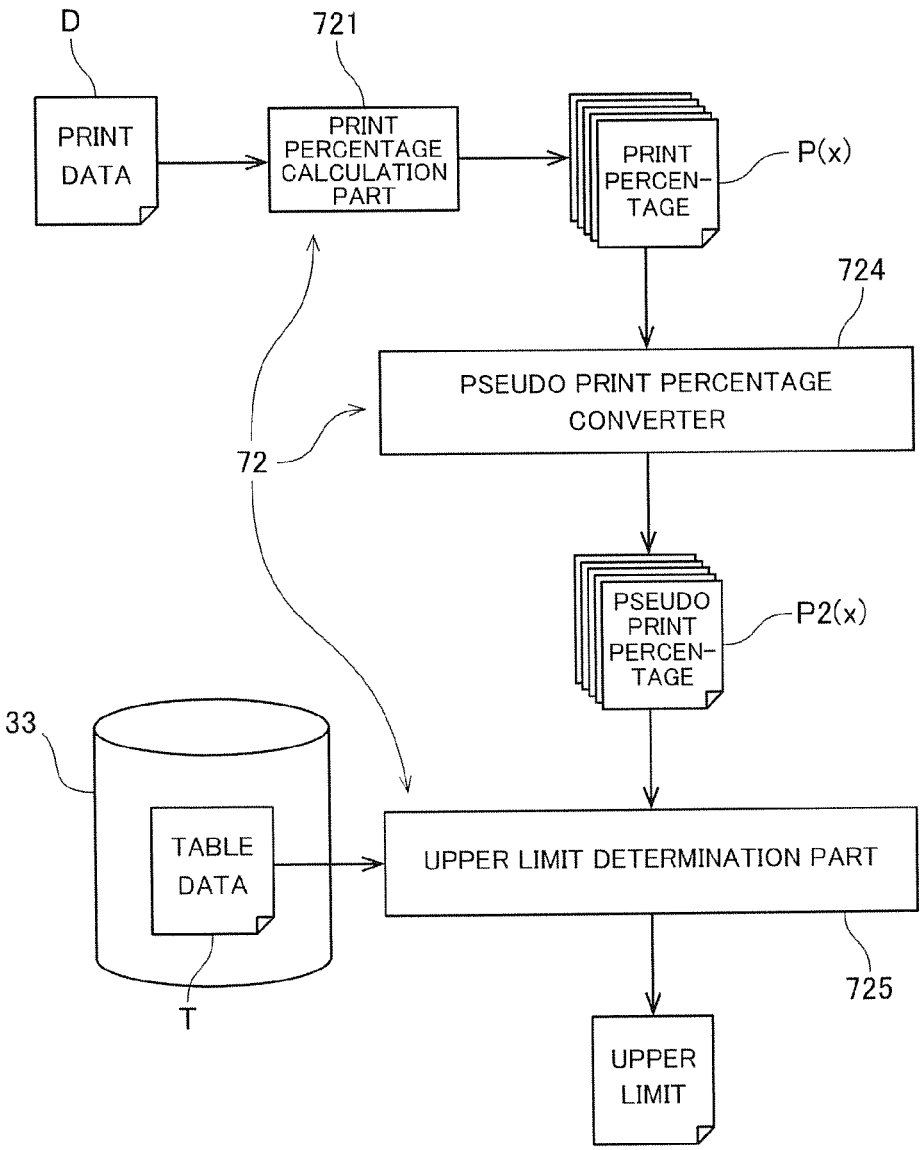
FIG. 13 is a block diagram showing the processes in Steps S2 and S3 according to the second preferred embodiment.

FIG. 12 is a flow diagram showing the details of the process in Step S3 in the second preferred embodiment. FIG. 13 is a block diagram conceptually showing the processes in Steps S2 and S3 in the second preferred embodiment. The print percentage calculation part 721, a pseudo print percentage converter 724 and an upper limit determination part 725 in FIG. 13 are parts of the computation part 72. The functions of the print percentage calculation part 721, the pseudo print percentage converter 724 and the upper limit determination part 725 are implemented by the computer program 331.

In Step S3 of the second preferred embodiment, the pseudo print percentage converter 724 initially converts the print percentage P for each of the blocks 60 included in the four head units 21 to 24 into a pseudo print percentage P2 in which the print percentages P of its surrounding blocks 60 are factored (in Step S21). Specifically, attention is initially focused on an x-th block 60 (where x=1, 2, 3, 4 and 5) in a head. Then, the pseudo print percentage P2(x) of the target block 60 (on which attention is focused) is calculated by substituting the print percentage P(x) of the target block 60 and the print percentage P(n) of a block 60 positioned n block(s) (where n=1, 2, 3 and 4) away from the target block 60 (the n-th block 60 from the target block 60) in the same head into Equations (1) to (3).

$$C(x)=A(x)\times[P(x)+\Sigma\{\alpha(n)\times P(n)\}] \quad (1)$$

$$C100(x)=100+\Sigma\{\alpha(n)\times 100\} \quad (2)$$

$$P2(x)=C(x)/C100(x)\times 100 \quad (3)$$

In Equations (1) and (2), α(n) is a weight coefficient indicating how much the block 60 positioned n block(s) away from the target block 60 influences the increase in temperature of the target block 60. In general, the weight coefficient α(n) decreases gradually with an increase in distance from the target block 60. Examples of previous settings of the weight coefficient α(n) are as follows: α(1)=0.3, α(2)=0.2, α(3)=0.1 and α(4)=0.

In Equation (1), A(x) is a position coefficient indicating the tendency of the target block 60 to increase in temperature. When there are differences in tendency to increase in temperature between the positions of the blocks 60 in each head (for example, when there is a difference in tendency to increase in temperature between a block near the center of the head and a block near an end thereof), the position coefficient A(x) is set at a numerical value other than 1 in accordance with the tendency to increase in temperature. Examples of previous settings of the position coefficient A(x) are as follows: A(1)=1.2, A(2)=1.0, A(3)=1.0, A(4)=1.0 and A(5)=1.4.

In Equation (1), the print percentages of surrounding blocks 60 are factored into the print percentage of the target block 60 in accordance with the weight coefficient α(n), and the result is multiplied by the position coefficient A(x), whereby a parameter C(x) is calculated. In Equation (2), a parameter C100(x) corresponding to the parameter C(x) assuming that all of the blocks 60 have a print percentage of 100% is calculated. Then, the ratio of the parameter C(x) to the parameter C100(x) is calculated as the pseudo print percentage P2(x) in Equation (3).

The use of such Equations (1) to (3) achieves the conversion of the print percentage P(x) of the target block 60 into the pseudo print percentage P2(x) in which the print percentages P of the surrounding blocks 60 are factored. The pseudo print percentage P2(x) is a parameter (second load factor) in which both a spontaneous temperature increase in the target block 60 and a temperature increase due to the influence of heat transferred from the surrounding blocks 60 are factored.

The pseudo print percentage converter 724 performs the calculations in Equations (1) to (3) while sequentially selecting all of the blocks 60 included in the four head units 21 to 24 as the target block 60. This provides a like plurality of pseudo print percentages P2(x) corresponding to the respective blocks 60. It should be noted that mathematical expressions for determining the pseudo print percentages P2(x) are not necessarily limited to Equations (1) to (3) mentioned above. Another equation which factors the print percentage P(n) of another block 60 positioned around the target block 60 into the print percentage P(x) of the target block 60 may be used in place of Equations (1) to (3).

Next, the upper limit determination part 725 determines a maximum value Pmax from among the obtained pseudo print percentages P2(x) of all blocks 60 (in Step S22). Thereafter, the upper limit determination part 725 references previously prepared table data T to determine a transport speed V (in Step S23).

FIG. 14 shows an example of the table data T for use in Step S23. The table data T is previously stored in the storage part 33 of the computer 30. The values of the transport speed V corresponding to the maximum value Pmax of the pseudo print percentages and the printing distance are specified in detail in the table data T. The numerical values in the table data T are previously determined by experiment and the like. By referencing the table data T, the upper limit determination part 725 is capable of determining the transport speed V corresponding to the maximum value Pmax of the pseudo print percentages provided in Step S22 and the printing distance represented by the print data D. The upper limit determination part 725 defines the transport speed V as the upper limit of the transport speed of the printing paper 9 transported by the transport mechanism 10.

In this manner, the second preferred embodiment also determines the upper limit of the transport speed while factoring in the print percentages P for the blocks 60. This provides the upper limit of the transport speed in consideration for not only a spontaneous temperature increase in each block 60 but also a temperature increase due to the influence of its surrounding blocks 60. This allows the blocks 60 in each of the head units 21 to 24 to operate at temperatures within a permissible range.

The second preferred embodiment is not required to prepare a plurality of table data T such as those in the first preferred embodiment but uses the single table data T to determine the upper limit of the transport speed. In particular, when there are a large number of blocks 60 in a head, the method of the second preferred embodiment requires only the single table data T whereas the method of the first preferred embodiment requires the same number of table data T as the blocks 60. Thus, the second preferred embodiment reduces burdens associated with the preparation and storage of the table data T.

<3. Modifications>

While the main preferred embodiments according to the present invention have been described hereinabove, the present invention is not limited to the aforementioned preferred embodiments.

Figure 15:
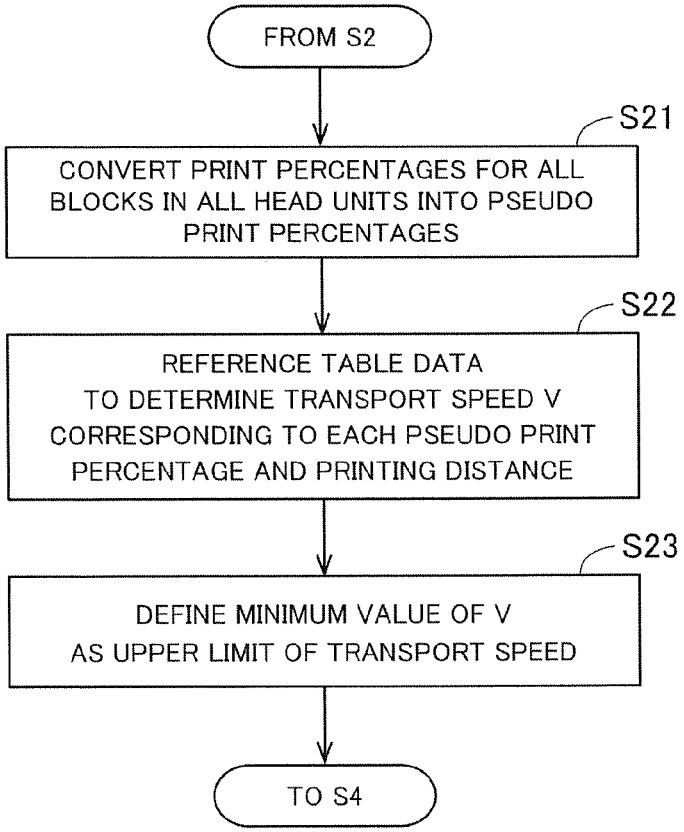
FIG. 15 is a detailed flow diagram of Step S3 according to a modification.

FIG. 15 is a flow diagram of Step S3 according to a modification of the second preferred embodiment. In the aforementioned example shown in FIG. 12, the transport speed corresponding to the maximum value Pmax of the pseudo print percentages P2(x) is defined as the upper limit of the transport speed of the printing paper 9 transported by the transport mechanism 10. In the example of FIG. 15, on the other hand, the transport speeds V corresponding to the respective pseudo print percentages P2(x) are initially determined, and the minimum value of the obtained transport speeds V is defined as the upper limit of the transport speed of the printing paper 9 transported by the transport mechanism 10.

A procedure for the process of FIG. 15 will be specifically described. The pseudo print percentage converter 724 initially converts the print percentages P of all blocks 60 into the pseudo print percentages P2 (in Step S21). Next, the upper limit determination part 725 references the table data T to determine a transport speed V corresponding to each pseudo print percentage P2 and the printing distance (in Step S22). This provides a plurality of transport speeds V corresponding to the respective pseudo print percentages P2. Thereafter, the minimum value of the transport speeds V is defined as the upper limit of the transport speed of the printing paper 9 transported by the transport mechanism 10 (in Step S23).

Figure 16:
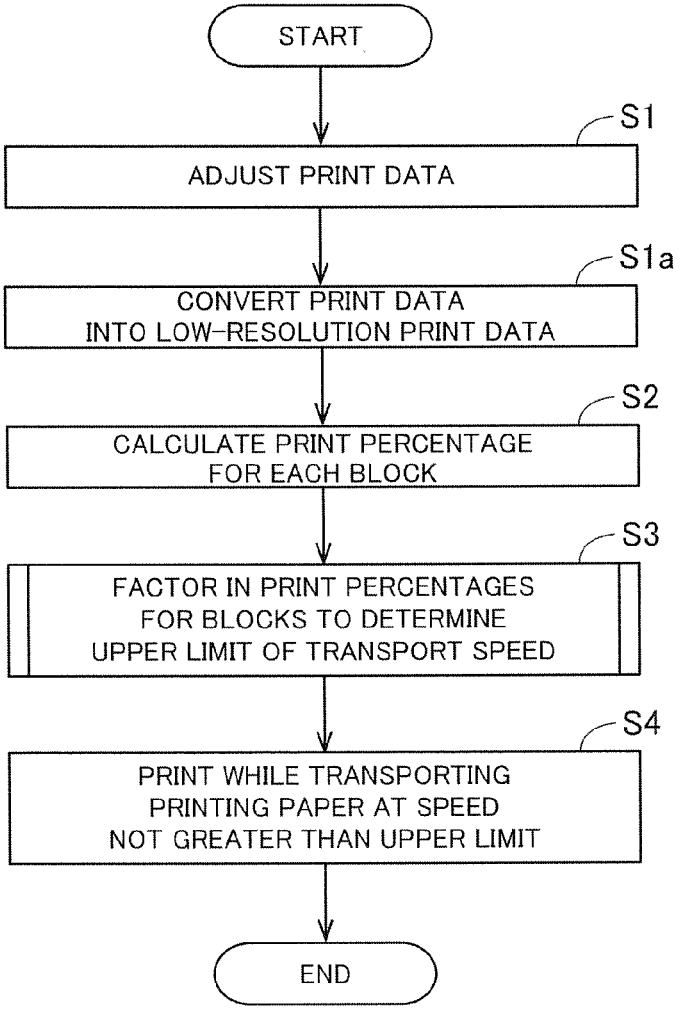
FIG. 16 is a flow diagram showing a procedure for the printing process according to another modification.

FIG. 16 is a flow diagram showing a procedure for the printing process according to another modification. In the example of FIG. 16, the data adjustment part 71 adjusts the print data D (in Step S1), and thereafter converts the print data D into low-resolution print data D (in Step S1*a*). Then, a print percentage P for each of the blocks 60 is calculated, based on the low-resolution print data D (in Step S2). In this manner, the calculation of the print percentage P after decreasing the resolution of the print data D reduces computation burdens on the calculation of the print percentage P. In particular, when the print data D prior to the conversion has a high resolution, this modification prevents the process in the computation part 72 from requiring longer time.

In the aforementioned preferred embodiments, the printing paper 9 is moved with respect to the fixed head units 21 to 24. Alternatively, the inkjet printer according to the present invention may be designed to move the head units along a surface of the fixed printing paper. Also, the inkjet printer according to the present invention may be designed to move both the printing paper and the head units. That is, the inkjet printer according to the present invention may include a transport mechanism which moves a recording medium in the transport direction relative to the heads.

In the aforementioned preferred embodiments, two heads are provided in one head unit. However, the number of heads in a head unit may be either one or not less than three. Also, the number of blocks in a head is not limited to five.

In the aforementioned preferred embodiments, the adjustment of the print data D (in Step S1), the calculation of the print percentage P for each block 60 (in Step S2) and the process of determining the upper limit of the transport speed (in Step S3) are performed in the inkjet printer 1. These processes, however, may be performed in a computer different than the inkjet printer 1. For example, a computer program for implementing these processes may be installed on a different computer connected to the server 2, so that the different computer executes the processes in Steps S1 to S3 and transfers the result of the processes to the computer 30 in the inkjet printer 1.

The configurations of the details of the inkjet printer may be different from those shown in the figures of the present invention. The components described in the aforementioned preferred embodiments and in the modifications may be consistently combined together, as appropriate.

While the invention has been described in detail, the foregoing description is in all aspects illustrative and not restrictive. It is understood that numerous other modifications and variations can be devised without departing from the scope of the invention.

What is claimed is:

1. An inkjet printer comprising:

a head for recording an image on a recording medium, based on print data;

a transport mechanism for moving said recording medium in a transport direction relative to said head;

a controller for controlling said head and said transport mechanism; and a computer comprising a computation part for determining the upper limit of a transport speed of said recording medium moved by said transport mechanism, based on said print data, said head including a plurality of blocks arranged in a width direction perpendicular to said transport direction, a plurality of nozzles arranged in said blocks, and a pressurizing mechanism for causing said nozzles to eject droplets, said computation part performing the steps of a) calculating a load factor indicative of a load on said pressurizing mechanism for each of said blocks, based on said print data, and b) factoring in said load factor for each of said blocks to determine the upper limit of said transport speed so that the upper limit becomes slower as said load factor increases and becomes slower as a printing distance in said transport direction corresponding to said print data increases, said controller controlling said transport mechanism at a transport speed not greater than said upper limit, wherein said step b) includes:

b11) calculating the maximum value of the sum total of said load factors of n blocks selected from among m blocks while changing the value of n in the range of $1 \leq n \leq m$ to provide m maximum values, where m and n are integers not less than 1;

b12) determining transport speeds corresponding respectively to the m maximum values; and b13) determining said upper limit, based on the minimum value of said m transport speeds wherein said transport mechanism moves said recording medium relative to said head at a transport speed not greater than said upper limit.

2. The inkjet printer according to claim 1, wherein the transport speeds corresponding respectively to the m maximum values are determined in said step b12) by referencing previously prepared table data.

3. The inkjet printer according to claim 1, further comprising a data adjustment part for adjusting submitted print data to provide print data for driving the head, wherein said computation part deter tines said upper limit, based on the print data subjected to the adjustment.

4. The inkjet printer according to claim 1, wherein said print data is converted into low-resolution print data, and said load factor is calculated, based on the low-resolution print data subjected to the conversion in said step a).

5. The inkjet printer according to claim 1, wherein a print percentage calculated based on said print data is defined as said load factor in said step a).

6. An inkjet printer comprising:

a head for recording an image on a recording medium, based on print data;

a transport mechanism for moving said recording medium in a transport direction relative to said head;

a controller for controlling said head and said transport mechanism; and a computer comprising a computation part for determining the upper limit of a transport speed of said recording medium moved by said transport mechanism, based on said print data, said head including a plurality of blocks arranged in a width direction perpendicular to said transport direction, a plurality of nozzles arranged in said blocks, and a pressurizing mechanism for causing said nozzles to eject droplets, said computation part performing the steps of a) calculating a load factor indicative of a load on said pressurizing mechanism for each of said blocks, based on said print data, and b) factoring in said load factor for each of said blocks to determine the upper limit of said transport speed so that the upper limit becomes slower as said load factor increases and becomes slower as a printing distance in said transport direction corresponding to said print data increases, said controller controlling said transport mechanism at a transport speed not greater than said upper limit, wherein said step b) includes:

b21) factoring the load factor of a block positioned around a target block included among the plurality of blocks into the load factor of the target block to perform the process of calculating a second load factor while sequentially selecting the blocks as the target block, thereby providing a plurality of second load factors; and b22) determining said upper limit, based on either a transport speed corresponding to the maximum value of the second load factors or the minimum value of transport speeds corresponding respectively to the second load factors wherein said transport mechanism moves said recording medium relative to said head at a transport speed not greater than said upper limit.

7. The inkjet printer according to claim 6, wherein the second load factor is calculated in said step b21) by further factoring in a position coefficient in accordance with the position of said target block in said head.

8. The inkjet printer according to claim 6, wherein the transport speeds corresponding respectively to the second load factors are determined in said step b22) by referencing previously prepared table data.

9. The inkjet printer according to claim 6, further comprising a data adjustment part for adjusting submitted print data to provide print data for driving the head, wherein said computation part determines said upper limit, based on the print data subjected to the adjustment.

10. The inkjet printer according to claim 6, wherein said print data is converted into low-resolution print data, and said load factor is calculated, based on the low-resolution print data subjected to the conversion in said step a).

11. The inkjet printer according to claim 6, wherein a print percentage calculated based on said print data is defined as said load factor in said step a).

12. A method of controlling an inkjet printer which records an image on a recording medium by ejecting ink droplets from a plurality of nozzles in a head by means of a pressurizing mechanism, based on print data, while moving the recording medium in a transport direction relative to the head, said method comprising the steps of:

a) calculating a load factor indicative of a load on said pressurizing mechanism for each block, based on said print data, said blocks being arranged in a direction perpendicular to said transport direction in said head;

b) factoring in said load factor for each of said blocks to determine the upper limit of said transport speed so that the upper limit becomes slower as said load factor increases and becomes slower as a printing distance in said transport direction corresponding to said print data increases; and c) moving said recording medium relative to said head at a transport speed not greater than said upper limit, wherein said step b) includes:

b11) calculating the maximum value of the sum total of said load factors of n blocks selected from among m blocks while changing the value of n in the range of $1 \leq n \leq m$ to provide m maximum values, where m and n are integers not less than 1;

b12) determining transport speeds corresponding respectively to the m maximum values; and b13) determining said upper limit, based on the minimum value of said m transport speeds.

13. A storage medium readable by a computer, the storage medium having stored therein a computer program for determining the upper limit of a transport speed in an inkjet printer which records an image on a recording medium by ejecting ink droplets from a plurality of nozzles in a head by means of a pressurizing mechanism, based on print data, while moving the recording medium in a transport direction relative to the head, said computer program causing a computer to perform the steps of:

a) calculating a load factor indicative of a load on said pressurizing mechanism for each block, based on said print data, said blocks being arranged in a direction perpendicular to said transport direction in said head; and b) factoring in said load factor for each of said blocks to determine the upper limit of said transport speed so that the upper limit becomes slower as said load factor increases and becomes slower as a printing distance in said transport direction corresponding to said print data increases, wherein said step b) includes:

b11) calculating the maximum value of the sum total of said load factors of n blocks selected from among m blocks while changing the value of n in the range of $1 \leq n \leq m$ to provide m maximum values, where m and n are integers not less than 1;

b12) determining transport speeds corresponding respectively to the m maximum values; and b13) determining said upper limit, based on the minimum value of said m transport speeds wherein said recording medium moves relative to said head at a transport speed not greater than said upper limit.

14. A method of controlling an inkjet printer which records an image on a recording medium by ejecting ink droplets from a plurality of nozzles in a head by means of a pressurizing mechanism, based on print data, while moving the recording medium in a transport direction relative to the head, said method comprising the steps of:

a) calculating a load factor indicative of a load on said pressurizing mechanism for each block, based on said print data, said blocks being arranged in a direction perpendicular to said transport direction in said head;

b) factoring in said load factor for each of said blocks to determine the upper limit of said transport speed so that the upper limit becomes slower as said load factor increases and becomes slower as a printing distance in said transport direction corresponding to said print data increases; and c) moving said recording medium relative to said head at a transport speed not greater than said upper limit, wherein said step b) includes:

b21) factoring the load factor of a block positioned around a target block included among the plurality of blocks into the load factor of the target block to perform the process of calculating a second load factor while sequentially selecting the blocks as the target block, thereby providing a plurality of second load factors; and b22) determining said upper limit, based on either a transport speed corresponding to the maximum value of the second load factors or the minimum value of transport speeds corresponding respectively to the second load factors.

15. A non-transitory computer-readable medium storing a computer program for determining the upper limit of a transport speed in an inkjet printer which records an image on a recording medium by ejecting ink droplets from a plurality of nozzles in a head by means of a pressurizing mechanism, based on print data, while moving the recording medium in a transport direction relative to the head, said computer program causing a computer to perform the steps of:

a) calculating a load factor indicative of a load on said pressurizing mechanism for each block, based on said print data, said blocks being arranged in a direction perpendicular to said transport direction in said head; and b) factoring in said load factor for each of said blocks to determine the upper limit of said transport speed so that the upper limit becomes slower as said load factor increases and becomes slower as a printing distance in said transport direction corresponding to said print data increases, wherein said step b) includes:

b21) factoring the load factor of a block positioned around a target block included among the plurality of blocks into the load factor of the target block to perform the process of calculating a second load factor while sequentially selecting the blocks as the target block, thereby providing a plurality of second load factors; and b22) determining said upper limit, based on either a transport speed corresponding to the maximum value of the second load factors or the minimum value of transport speeds corresponding respectively to the second load factors wherein said recording medium moves relative to said head at a transport speed not greater than said upper limit.

* * * * *